United States Patent [19]

Petersen et al.

[11] Patent Number: 4,683,370

[45] Date of Patent: Jul. 28, 1987

[54] HOT AIR GUN WITH AIR DIRECTING HOUSING

[75] Inventors: Walter J. Petersen, Eden Prairie; John M. Svendsen, New Hope, both of Minn.

[73] Assignee: Wagner Spray Tech Corporation, Minneapokis, Minn.

[21] Appl. No.: 639,663

[22] Filed: Aug. 8, 1984

[51] Int. Cl.[4] ..... H05B 3/00; F24H 3/04; A45D 20/10

[52] U.S. Cl. ..... 219/370; 34/97; 34/243 R; 219/366; 219/367; 219/368; 219/373; 219/380; 219/381

[58] Field of Search ..... 219/366–370, 219/373–382; 34/96–101, 243 R

[56] References Cited

U.S. PATENT DOCUMENTS

| | | | |
|---|---|---|---|
| 1,416,601 | 5/1922 | Boone | 219/366 X |
| 1,455,034 | 5/1923 | Small | 34/243 R |
| 1,694,351 | 12/1928 | Long | 219/368 X |
| 1,699,739 | 1/1929 | Kercher et al. | 219/366 |
| 1,900,956 | 3/1933 | Somersall | 219/368 X |
| 2,049,812 | 8/1936 | Loacker | 34/243 R |
| 2,052,983 | 9/1936 | Long | 219/375 X |
| 2,078,548 | 4/1937 | Strawser | 219/364 X |
| 2,120,795 | 6/1938 | Boothby | 219/374 X |
| 2,158,601 | 5/1939 | Wiegand | 219/375 X |
| 2,158,602 | 5/1939 | Calhoun | 219/370 X |
| 2,481,760 | 9/1949 | Leher . | |
| 2,527,013 | 10/1950 | Kjelgaard | 219/380 X |
| 2,577,269 | 12/1951 | Richardson et al. . | |
| 2,594,101 | 4/1952 | Volker | 219/366 |
| 2,609,477 | 9/1952 | Borda et al. | 219/380 |
| 2,765,393 | 10/1956 | Theisen | 219/364 |
| 2,797,297 | 6/1957 | Nihlen | 219/381 X |
| 2,819,378 | 1/1958 | Nokes et al. | 219/375 X |
| 2,839,657 | 6/1958 | Mast | 219/370 X |
| 3,094,606 | 6/1963 | Ferris . | |
| 3,109,083 | 10/1963 | Meltzer . | |
| 3,115,567 | 12/1963 | Meltzer . | |
| 3,116,394 | 12/1963 | Barton | 219/382 |
| 3,492,462 | 1/1970 | Schumacher | 219/374 X |
| 4,135,080 | 1/1979 | Wells | 34/97 X |
| 4,260,875 | 4/1981 | Walter et al. | 219/364 |

FOREIGN PATENT DOCUMENTS

| | | | |
|---|---|---|---|
| 1076222 | 2/1960 | Fed. Rep. of Germany | 219/380 |
| 905176 | 9/1962 | United Kingdom | 219/370 |

*Primary Examiner*—Anthony Bartis

*Attorney, Agent, or Firm*—Hill, Van Santen, Steadman & Simpson

[57] ABSTRACT

A hot air gun or blower of the type usable for blistering paint on a painted surface for easing the removal of paint thereof has a housing with internal brackets supporting and retaining a switch assembly, a circuit board, a motor having an impeller, a motor mount, a shroud surrounding the impeller, and a heating element. The internal brackets supporting these elements are configured so as to provide a number of air passages between the elements and the interior wall of the housing. In addition to drawing air through a rear portion of the gun, air is drawn through an annular opening in the front of the gun between the cover for the heating element and the housing. The air thus passes over the covered heating coil and is preheated before being blown by the impeller directly over the coil for primary heating. At least one wave-like flange is received between spaced interior brackets in the housing for providing a press fit of the components between the two housing halves, thus eliminating the need for mechanical fasteners for mounting the components of the gun.

26 Claims, 10 Drawing Figures

HOT AIR GUN WITH AIR DIRECTING HOUSING

BACKGROUND OF THE INVENTION

1. Field of the Invention

The present invention relates to hand-held blower devices, and in particular to a hot air gun for blistering paint for easing removal thereof from a painted surface.

2. Description of the Prior Art

Many types of hand-held hot air blower devices are known in the art which direct a flow of heated air at an object. Devices of this type which are specifically designed for the purpose of but not limited to directing heat at a painted surface, thereby causing the paint to blister to facilitate the subsequent removal thereof from the surface are described, for example, in U.S. Pats. Nos. 1,995,240; 2,481,760; 2,577,269; 3,094,606; 3,109,083 and 3,115,567.

Such conventional units, in order to achieve the necessary high temperature elevation and required volume of air movement, are cumbersome and generally employ a considerable number of cooperating components, many of which are prone to failure over continued use. Units, of the type such as hand-held hair dryers, sacrifice high temperature elevation and add high volume of air handling in order to achieve the smaller, more manageable size without overheating of inexpensive components. Such units are generally not acceptable for paint removal purposes because those devices cannot attain the necessary air temperature required to effectively blister the paint.

SUMMARY OF THE INVENTION

It is an object of the present invention to provide a hand-held hot air gun for but not limited to directing a flow of heated air at a painted surface for blistering the paint and thereby easing removal thereof from the surface which is lightweight, easily manageable, and has a simplified construction contributing to a longer useful life without failure.

It is a further object of the present invention to provide such a hot air gun which has a number of components retained in a housing with as few mechanical fastening means as possible.

Another object of the present invention is to provide such a hot air gun which promotes efficient operation by preheating air drawn into the unit before the air is directed over a heating means for primary heating. The air drawn in the front of the unit also substantially reduces the temperature of outside case; this allows us to pass U.L. temperature requirement with lower cost plastics and supplies more operator comfort.

A further object of the present invention is to provide such a hot air gun having a "clam shell" housing assembly consisting of two halves, each housing half having a number of brackets for supporting the interior components, which brackets simultaneously form a number of air passages in combination with the supported components.

The above objects are inventively achieved in a hot air gun having a housing consisting of two joined mirror-image halves, each of which has a plurality of brackets therein for supporting components such as a switch assembly, a circuit board, a motor with an impeller, a motor mount, a shroud surrounding the impeller and a heater unit, within the housing. The motor, motor mount, shroud and heater unit are retained in the brackets so as to form a continuous assembly. The brackets for supporting this assembly are formed in spaced pairs, with adjacent flanges of the respective units being received between the brackets, and being retained therein when the two halves of the housing are joined and held together by suitable fasteners.

In order to provide a tight press fit, the flange may be made wave-like along a portion of the circumference to increase flange thickness to extert pressure between the brackets to maintain the adjacency o fthe flanges received between the brackets, as well as tightly retaining the entire assembly so that no rattle or other vibration-induced noise results during operation of the air gun.

The brackets are arranged within the housing with radial spaces therebetween so as to provide a plurality of air inlet passages in cooperation with the interior housing wall and the exterior walls of the various components. The housing for the gun has a plurality of air inlet openings at a rear thereof through which air is drawn by the action of the motor-driven impeller, and which is subsequently blown across a resistance coil of the heater unit. Additionally, the gun has an annular air inlet opening at a front portion thereof surrounding the metal casing of the heater unit. Air is also drawn through this opening and is thus preheated by the heat dissipated through the metal casing and case halves. This air is further drawn by the action of the impeller through the passages formed by the support brackets in the housing to a rear of the impeller, and the preheated air is thus directed with the unheated inlet air over the coil for primary heating thereof.

DESCRIPTION OF THE PREFERRED EMBODIMENTS

Figures 1, 2, 6, 7, 8:
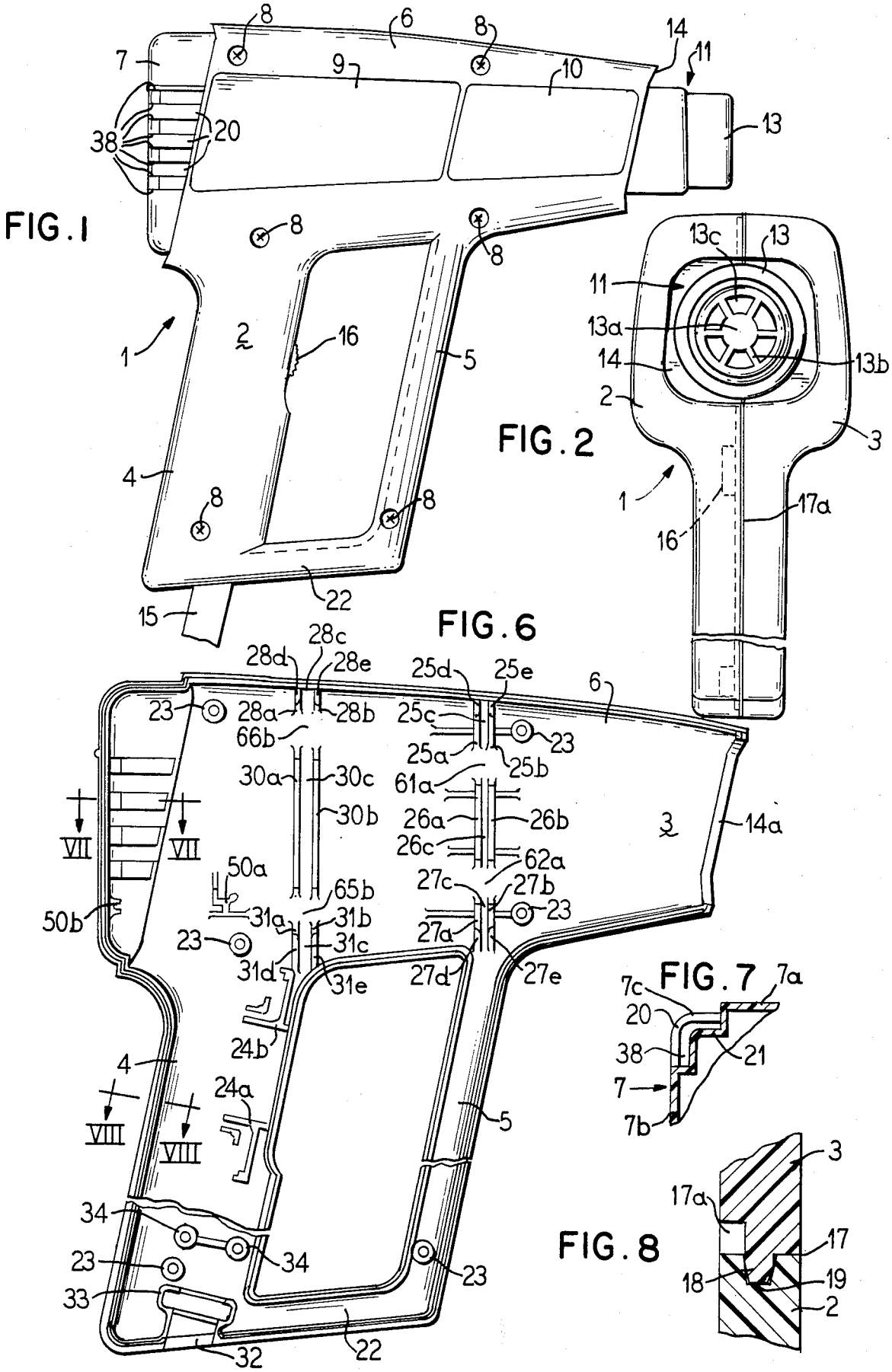
FIG. 1 is a side elevational view of a hot air gun constructed in accordance with the principles of the present invention.
FIG. 2 is a front elevational view of the hot air gun shown in FIG. 1.
FIG. 6 is a side elevational view of the interior of one-half of the housing shown in FIG. 3 with the interior components removed therefrom.
FIG. 7 is a sectional view of a portion of the housing shown in FIG. 6 taken along line VII—VII.
FIG. 8 is a sectional view of a portion of the housing shown in FIG. 6 taken along line VIII—VIII.

A hand-held hot air gun constructed in accordance with the principles of the present invention is shown in exterior side and front elevational views in FIGS. 1 and 2. The gun 1 has a housing comprised of two housing shells 2 and 3. When joined, the shells 2 and 3 provide a pistol grip 4, a guard 5 joined to the grip 4 by a connector 22, and a barrel portion 6. The shells 2 and 3 further form an air inlet baffle 7 having a plurality of rearward air inlets 38, described in greater detail below.

The shells 2 and 3 are held together by a plurality of fasteners 8, such as screws. The exterior of the barrel portion 6 may have indentations 9 and 10 for receiving manufacturer's labels, warnings, and the like. The shells 2 and 3 may consist, for example, of plastic.

The housing formed by the joined shells 2 and 3 contains a heater unit 11, having an exterior metal casing 13, a portion of which projects from an opening 14 at the front of the gun 1. As shown in FIG. 6, the opening 14 is formed by a rim 14*a* of each of the shells 2 and 3. The front of the casing 13, as best seen in FIG. 2, has a guard to prevent most objects from coming into contact with the heating coil disposed inside the casing 13. The guard is in the form of a centrally disposed hub 13*a* having a plurality of radially extending struts 13*b* joining the hub 13*a* to the casing 13. A plurality of radial apertures 13*c* are thus formed between the struts 13*b* for permitting outward flow of heated air.

The gun 1 has an acutator 16 which is part of a switch assembly 36 (shown in FIG. 3) received in the housing formed by the shells 2 an 3. The actuator 16 projects to the exterior of the gun 1 through an elongated opening 4*a* formed by the shells 2 and 3, and is slideable therein to turn the motor operating the gun 1 on and off, and to operate the motor at different speeds and the heater at lower wattage and temperature ranges. A heavy duty electrical cord 15 is received within the housing formed by the shells 2 and 3 for supplying power to the gun 1.

As best seen in FIG. 8, the two shells 2 and 3 are joined by a tongue-and-groove arrangement. A tongue 18 is carried at the perimeter of the shell 3 and a complementary shaped groove 19 is carried along the corresponding perimeter of the shell 2. When the tongue 18 is received in the groove 19, an interior seam 17 and an exterior recess 17*a* are formed. The recess 17*a* facilitates prying apart of the shells 2 and 3 if necessary, after removal of the fasteners 8 and improves appearance.

Figures 3, 4, 5, 9, 10:
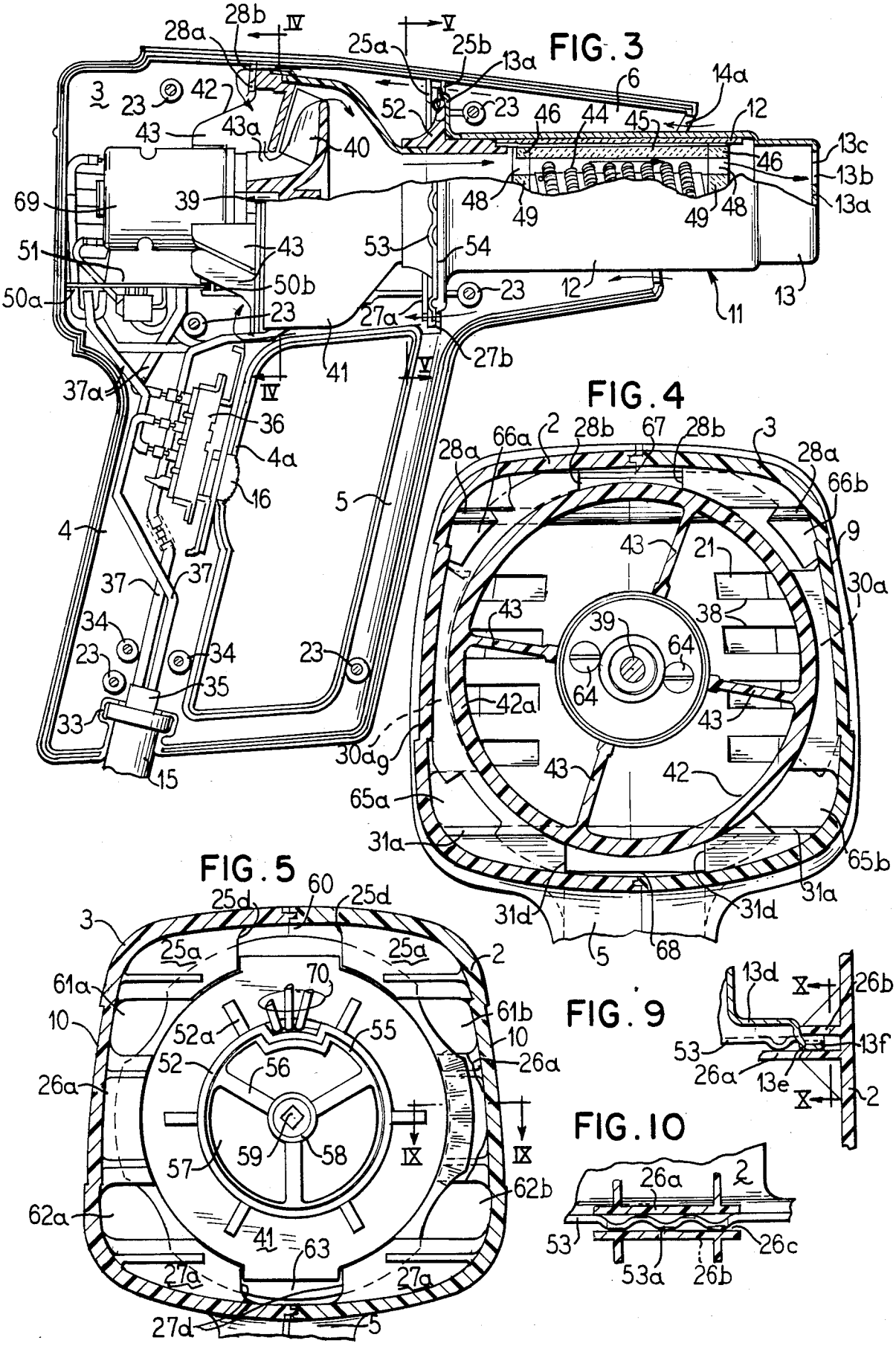
FIG. 3 is a side elevational view, partly in section, of the hot air gun shown in FIG. 1 with one-half of the housing removed exposing the interior components.
FIG. 4 is a sectional view of the hot air gun shown in FIG. 3 taken along line IV—IV.
FIG. 5 is a sectional view of the hot air gun shown in FIG. 3 taken along line V—V.
FIG. 9 is a sectional view of a portion of the housing shown in FIG. 5 taken along line IX—IX.
FIG. 10 is a sectional view of the portion of the housing shown in FIG. 9 taken along line X—X.

As shown in FIG. 3, the gun 1 contains a number of internally disposed components which are mounted in the shells 2 and 3. It will be understood that the shells 2 and 3 are essentially mirror images, and therefor in FIG. 3 components are only shown received in the shell 3, and in FIG. 6 only the details of the shell 3 are shown. The main components received and retained in the shells 2 and 3 are the aforementioned switch assembly 36, a circuit board 51, a motor 69 having an impeller 40, a motor mount 42, a shroud 41 surrounding the impeller 40, and the aforementioned heater unit 11. Further details of the cooperation among and mounting of these components are described below. The switch assembly 36 is received in spaced brckets 24*a* and 24*b* (shown in FIG. 6) in the housing shell 3. The switch assembly 36 is connected via leads 37 in a standard manner to the exterior power cord 15. The exterior power cord 15 terminates in a flanged collar 35 which is received in an annular retainer 33 formed in the shell 3. The posts 34 may be provided if the cord is to be equipped with a strain relief in addition to a molded cord set relief.

The switch assembly 36 has further leads 37*a* connected to the circuit board 51 in a standard manner. The circuit board 51 includes rectifying components and other circuitry necessary for operating the motor 69 and providing two heat output settings, the details of which are well known to those skilled in the art, and therefore the specific wiring need not be described in greater detail. The circuit board 51 is retained in spaced brackets 50*a* and 50*b* formed in the shell 3.

The motor mount 42 has a plurality of radial fins 43 which in combination form an annular receptacle, as best seen in FIG. 4, for receiving the motor 69. The motor 69 is held therein by suitable fasteners 64, such as screws. As stated above, the motor 69 has a shaft 39 on which an impeller 40 having a plurality of radially extending impeller vanes is mounted. The impeller 40 is rapidly rotated by the motor 69.

The impeller 40 is surrounded by a shroud 41 disposed adjacent to the motor mount 42. The shroud 41 collects and directs air moved by the impeller 40 and communicates with the heater unit 11 for transporting the air moved by the impeller 40 over a resistance heating coil 44 in the heater unit 11. The heater unit 11 has a plastic annular connector 52 which receives the shroud 41. The connector 52 is disposed adjacent a ceramic end cap 46 having a plurality of radial vanes 48 extending from a central hub 49 so as to provide a plurality of radial apertures therebetween for permitting air flow therethrough. The end cap 46 is adjacent a hollow cylindrical ceramic sleeve 45 which is closed at its opposite end by another identical end cap 46, also having apertures therein for permitting air flow therethrough, so as to provide a ceramic shell for the resistance heater coil 44. The coil 44 is helically wound on a ceramic core disposed within the ceramic shell. An insulating sleeve 12 is disposed between the ceramic shell and the metal casing 13. As best seen in FIG. 5, the connector 52 has an interior rim 55 from which a plurality of struts 56 radially inwardly project and join a central hub 58. The hub 58 as well as the end caps 46 and the ceramic core about which the coil 44 is wound each have a central square bore therein for receiving a square retainer 59 which fixes the relative radial positions of those components. A plurality of leads 70 for supplying current to the coil 44 are guided by the connector 52 and are connected to the circuit board 51 and power cord 15.

Each housing shell 2 and 3 has a plurality of bracket pairs integrally formed in the interior thereof for receiving and retaining the above-identified components. Each shell has an upper forward bracket pair consisting of brackets 25*a* and 25*b* forming a receptacle 25*c* therebetween. The bracket 25*a* has a substantially vertical wall 25*d* and the bracket 25*b* has a corresponding substantially vertical wall 25*e*. When the halves 2 and 3 are joined, the vertical walls form an air passage 60 therebetween as shown in FIG. 5.

Each housing shell 2 and 3 further has a forward central bracket pair consisting of brackets 26*a* and 26*b* forming a receptacle 26*c* therebetween. As also best seen in FIG. 5, air passages 61*a* and 61*b* are formed between the upper forward bracket pair and the central forward bracket pair.

Each housing shell 2 and 3 further has a lower foward bracket pair consisting of brackets 27*a* and 27*b*, forming a receptacle 27*c* therebetween. The bracket 27*a* has a substantially vertical wall 27*d* and the bracket 27*b* has a substantially vertical wall 27*e*. As best seen in FIG. 5, an air passage 63 is formed between these vertical walls when the halves 2 and 3 are joined. Additional air passages 62*a* and 62*b* are formed between the central forward bracket pair and the lower forward bracket pair. The rear bracket pairs 30*a*, 30*b* and 31*a*, 31*b* are similarly equipped at 66*b* and 65*b*.

Each housing shell 2 and 3 has an upper rear bracket pair 28*a* and 28*b* forming a receptacle 28*c* therebetween. The bracket 28*a* has a generally vertical wall 28*d* and the bracket 28*b* has a generally vertical wall 28*e* which, as best seen in FIG. 4, form an air passage 67 when the halves 2 and 3 are joined.

Each housing shell 2 and 3 further has a central rear bracket pair consisting of brackets 30*a* and 30*b* forming a receptacle 30*c* therebetween. Additional air passages 66*a* and 66*b*, as best seen in FIG. 4, are formed between the upper rear bracket pair and the central rear bracket pair.

Each housing shell 2 and 3 also has a lower rear bracket pair consisting of brackets 31*a* and 31*b* forming a receptacle 31*c* therebetween. The bracket 31*a* has a generally vertical wall 31*d* and the bracket 31*b* has a generally vertical wall 31*e* which, when the housing halves 2 and 3 are joined, form an air passage 68 therebetween, as best seen in FIG. 4. Air passages 65*a* and 65*b*, as best seen in FIG. 4, are formed between the central rear bracket pair and the lower rear bracket pair.

The housing shell 3 has a plurality of fastener-receiving bosses 23 for receiving the fasteners 8. The housing shell 2 has a plurality of apertures therein in registry with the bosses 23. Additionally, as shown in FIG. 6, several of the brackets have supporting struts extending substantially perpendicularly therefrom for stiffening and strengthening the brackets. The struts have not been numbered for purpose of clarity.

As shown in FIGS. 3 and 5, and in further detail in FIGS. 9 and 10, the connector 52 is forced into tight adjacent connection with the shroud 41 by a flange thickener 53 which extends around the periphery of the connector 52. The thickener 53, as shown in detail in FIG. 9, is received, for example, between brackets 26*a* and 26*b* together with a hook 13*e* carried on a flange 13*d* of the metal casing 13 of the heater unit 11. The free end 13*f* of the hook 13*e* is slightly bent so as to facilitate insertion of the components between the brackets 26*a* and 26*b* by initially slightly spreading the brackets apart. This substantially eliminates vibration during operation, thereby contributing to longer component life and further contributing to quieter operation by minimizing vibration-induced noise and rattling. The mounting details shown in FIG. 9 for the brackets 26*a* and 26*b* apply as well to all forward bracket pairs shown in FIG. 6.

A peripheral rim 42*a* of the motor mount 42 and a peripheral rim of the shroud 41 is received between the three rearward pairs of brackets in the gun 1, as shown in FIGS. 3 and 4, and is thus tightly fixed, so as to provide a substantially sealed air communication passage therethrough.

As mentioned above, the rear baffle 7 of the gun 1 has a plurality of air inlet openings 38 therein. As shown in detail in FIG. 7, the rear baffle 7 is composed of a rear wall 7*a*, side wall 7*b* and peripheral corner 7*c* where the inlets 38 are formed by a plurality of stepped walls 21 which alternate with curved walls 20, the inlets 38 being formed therebetween above and below the curved walls 20.

Air flow within the gun 1 directed by a combination of the above identified air passages acting in cooperation with the components disposed in the interior of the gun 1 is indicated by the arrows shown in FIG. 3. Air is drawn through the rear inlets 38 by the action of the impeller 40 through a radial opening 43*a* in the motor mount 42, passes over the vanes of the impeller 40, is collected by the shroud 41 and directed in a uniform stream over the heating coil 44, and exits the gun through the openings 48 in the end cap 46 and the openings 13*c* in the metal casing 13. Additionally, air is drawn inwardly through the opening 14 in the front of the gun 1 by the action of the impeller 40. This air passes between the exterior of the metal casing 13 of the heater unit 11 and the interior walls of the housing shells 2 an 3, and is thus preheated as it passes over the casing 13. After such preheating, the air is drawn through the passages 60, 61*a*, 61*b*, 62*a*, 62*b* and 63 shown in FIG. 5. The air flows around the exterior of the shroud 41 and then through passages 67, 66*a*, 66*b*, 65*a*, 65*b* and 68 shown in FIG. 4. The air is then drawn through the opening 43*a* and is mixed with the rear inlet air from the inlets 38 for primary heating by movement over the coil 44. Preheating of a portion of the ambient air not only raises the temperature of the output air without the expenditure of additional input power, thereby resulting in a higher output air temperature per energy unit input, but also reduces the temperature of the plastic housing shells 2 and 3 by drawing heat away therefrom with continuous air movement, resulting in improved operator comfort.

As described above, the entire unit is assembled using a small number of mechanical fasteners; the only mechanical fasteners required are the fasteners 64 for affixing the motor 69 to the motor mount 42, and the fasteners 8 used to hold the housing shells 2 and 3 together. All other components are retained in the gun 1 by press fit.

The concept of reverse air flow from opening 14*a* both preheats a portion of the air and cools the housing around the heater unit 11. Testing has shown the structure for reverse air flow also provides substantial improvement in performance material to operator protection and cooldown after use if the unit is supported tip up on a flat rear wall of the housing formed by the rear baffle 7, as shown in FIG. 1, to provide natural convection flow through the unit from opening 38 through opening 14.

Although modifications and changes may be suggested by those skilled in the art it is the intention of the inventors to embody within the patent warranted hereon all changes and modifications as reasonably and properly come within the scope of their contribution to the art.

We claim as our invention:

1. A hand-held hot air gun comprising:

a housing having an air inlet means for admitting fresh air into said housing;

a motor supported in a motor mount in said housing, said motor having an impeller for drawing air into said housing through said inlet means;

a shroud in said housing surrounding said impeller for receiving air drawn in by said impeller and having an air inlet and an air outlet;

a heater unit in said housing having a first end forming an inlet communicating with the outlet of said shroud for receiving and heating air therefrom and a second end defining an air outlet from which heated air is discharged out of said housing; and air directing means including a plurality of brackets integrally formed on an interior of said housing including front brackets supporting and retaining said first end of said heating unit, in spaced relation to the interior surface of said housing, and rear brackets supporting and retaining said motor mount located a predetermined distance away from said front brackets on the side of said front brackets opposite said heater unit with said shroud being press fit between said heating unit and said motor mount in sealed relation therewith, said plurality of brackets defining a plurality of air passages in said housing in cooperation with respective exterior surfaces of said shroud and heater unit communicating said housing air inlet means with said shroud air inlet, at least one of said air passages being adjacent said exterior surface of said heater unit for preheating air flowing through said at least one of said air passages.

2. A hand-held hot air gun as claimed in claim 1 wherein said housing air inlet means includes a plurality of air inlets disposed at a rear of said housing, and at least one air inlet disposed at a front of said housing with said motor and said impeller disposed at said rear of said housing and said second end of said heating unit disposed at said front of said housing.

3. A hand-held hot air gun as claimed in claim 2, wherein said air inlet disposed at a front of said housing is an annular inlet defined by a circular opening in a front of said housing through which said heater unit extends and said exterior surface of said heater unit.

4. A hot air gun as claimed in claim 2, wherein said front and rear inlets define a convection air path therebetween in said housing including said air passages when said gun is disposed after use in a generally upright position with said front air inlet disposed above said rear air inlets for cooling said heating unit and said housing.

5. A hot air gun as claimed in claim 4 further comprising a baffle having a rear wall which can support said hot air gun in said upright position.

6. A hot air gun as claimed in claim 5, wherein said baffle has sides adjacent said rear wall and joined thereto at peripheral corners and wherein said rear inlets are disposed in said baffle, said rear inlets extending to at least one of said peripheral corners and through the adjacent side wall of said housing, so that said rear inlets are not blocked when said gun is supported in said upright position.

7. A hand-held hot air gun as claimed in claim 1 wherein each of said pluralities of front and rear brackets consists of a plurality of bracket pairs, each bracket pair defining a receptacle therebetween with the bracket pairs in said plurality of front brackets receiving a portion of said first end of said heater unit in said receptacle and the bracket pairs in said plurality of rear brackets receiving a portion of said motor mount in said receptacle.

8. A hand-held hot air gun as claimed in claim 1 wherein said plurality of front brackets comprises for each longitudinal interior side of said housing:

a pair of spaced upper forward brackets;

a pair of spaced central forward brackets;

a pair of spaced lower forward brackets, said pair of central forward brackets being spaced from said pairs of upper and lower forward brackets so as to define air passages therebetween;

said plurality of rear brackets comprises for each longitudinal interior side of said housing a pair of spaced upper rear brackets;

a pair of spaced central rear brackets;

a pair of spaced lower rear brackets, said pair of central rear brackets being spaced from said upper and lower pairs of rear brackets for defining air passages therebetween;

said upper and lower forward pairs of brackets in one longitudinal interior side of said housing defining upper and lower air passages in cooperation with corresponding upper and lower forward pairs of brackets spaced therefrom in the other longitudinal interior side of said housing; and said upper and lower rear pairs of brackets in one longitudinal interior side of said housing defining further upper and lower air passages in cooperation with corresponding upper and lower rear pairs of brackets spaced therefrom in said other longitudinal interior side of said housing.

9. A hand-held hot air gun as claimed in claim 1 wherein said heater unit has a flange, and further comprising a sinusoidal spring substantially in registry with said flange and received in at least one of said brackets of said plurality of brackets with said flange for rigidly retaining said heater unit and said shroud and said motor connected thereto within said housing.

10. A hot air gun as claimed in claim 1, wherein said housing consists of two joined symmetric shells.

11. A hand-held hot air gun comprising:

a housing having a front opening defining an air inlet;

a motor inside said housing rearwardly of said front opening having an impeller for drawing into said housing through said air inlet;

a motor mount receiving and supporting said motor;

a shroud connected to said motor mount in said housing and surrounding said impeller and having an inlet for receiving air drawn in by said impeller and an outlet;

a heater unit having a flange in said housing, said heater unit including a first end connected with the outlet of said shroud for receiving and heating air therefrom, said heater unit having a second end extending through said front opening of said housing from which heated air is discharged from said gun;

a first set of brackets receiving said flange of said heater unit;

a second set of brackets receiving a peripheral rim of said motor mount;

said first and second sets of brackets being the sole supporting and retaining means for said heater unit and said motor mount, with said shroud press fit in sealed relation therebetween; and a plurality of air inlet passages communicating with said impeller and said front opening of said housing, said passages defined by said first and second sets of brackets in combination with respective exterior surfaces of said heater unit, said shroud and said motor mount, and in combination with an interior surface of said housing, at least one of said air passages being adjacent said exterior surface of said heater unit for preheating air flowing through said at least one of said air passages drawn into said housing through said front opening.

12. A hand-held hot air gun as claimed in claim 11 wherein said first set of brackets comprises for each longitudinal interior side of said housing:

a pair of spaced upper forward brackets;

a pair of spaced central forward brackets;

a pair of spaced lower forward brackets, said pair of central forward brackets being spaced from said pairs of upper and lower forward brackets so as to define air passages therebetween;

said second set of brackets comprises for each longitudinal interior side of said housing a pair of spaced upper rear brackets;

a pair of spaced central rear brackets;

a pair of spaced lower rear brackets, said pair of central rear brackets being spaced from said upper and lower pairs of rear brackets for defining air passages therebetween;

said upper and lower forward pairs of brackets in one longitudinal interior side of said housing defining upper and lower air passages in cooperation with corresponding upper and lower forward pairs of brackets spaced therefrom in the other longitudinal interior side of said housing; and said upper and lower rear pairs of brackets in one longitudinal interior side of said housing defining further upper and lower air passages in cooperation with corresponding upper and lower rear pairs of brackets spaced therefrom in said other longitudinal interior side of said housing.

13. A hand-held hot air gun as claimed in claim 11 further comprising:

a sinusoidal spring in registry with said flange of said heater unit and received with said flange in said first set of brackets for rigidly retaining said heater unit, said shroud, and said motor mount connected thereto in said housing.

14. A hand-held hot air gun as claimed in claim 11 further comprising;

a circuit board having electrical circuitry thereon for operating said motor; and a pair of spaced additional brackets in said housing for supporting and retaining said circuit board.

15. A hand-held hot air gun as claimed in claim 11 further comprising:

a plurality of air inlets disposed at a rear of said housing opposite said front opening of said housing.

16. A hand-held hot air gun as claimed in claim 15 wherein said front opening in said housing is an annular opening defined by a circular front rim of said housing and said exterior surface of said heater unit.

17. A hand-held hot air gun as claimed in claim 11 wherein said flange has a curved free end for facilitating insertion of said flange in said forward brackets.

18. A portable, hand-held hot air gun comprising:

a housing having a front opening defining a first air inlet and a baffle having a rear wall and adjacent side walls joined thereto at peripheral corners, and having an opening therein defining a second air inlet said opening extending to at least one of said peripheral corners and through the adjacent side wall of said baffle so that said second air inlet is not blocked when said gun is in an upright position;

a heating unit in said housing having an inlet end within said housing and an outlet end projecting through said front opening for discharging heated air from said gun;

blower means in said housing communication with said first and second air inlets for drawing fresh air into said housing therethrough and for directing siad air through the inlet end of said heating unit for heating and discharging said air;

air passage means communicating said front opening with said blower means disposed for drawing said fresh air into said housing through said front opening over the outer surface of said heating unit for pre-heating said fresh air before being blown through said heating unit and out of said front opening; and said first and second air inlets being disposed for defining a convention air path therebetween in said housing including said air passage means when said gun is disposed after use in said generally upright position with said first air inlet above said second air inlet for cooling said heating unit and said housing

19. A hot air gun as claimed in claim 18 wherein said heating unit has an external heat conducting shell.

20. A hot air gun as claimed in claim 19 wherein said external heat conducting shell has a radially extending heat conducting flange disposed in said air passages.

21. A hot air gun as claimed in claim 19 wherein said exterior heat conducting shell is a metal tube.

22. A hot air gun as claimed in claim 21 wherein said metal tube has a portion which projects out of and beyond said front opening forming said end of said heating unit.

23. A hot air gun comprising:

a housing having a front opening;

a motor inside said housing having an impeller for drawing air into said housing;

a motor mount receiving and supporting said motor;

a shroud connected to said motor mount in said housing and surrounding said impeller for receiving air drawn in by said impeller and having an air inlet and an air outlet;

a heater unit having a flange in said housing and said heater unit having an inlet end connected with the outlet of said shroud for receiving and heating air therefrom, said heater unit having a second end extending through said front opening of said housing from which heated air is discharged from said gun;

a first set of brackets in said housing receiving said flange of said heat unit;

a second set of brackets in said housing receiving a peripheral rim of said motor mount;

said first and second sets of brackets being the sole supporting and retaining means for said heater unit and said motor mount, with said shroud press fit in sealed relation therebetween; and a plurality of air inlet passages communicating with said impeller and said front opening of said housing, said passages being defined by said first and second sets of brackets in combination with respective exterior surfaces of said heater unit, said shroud and said motor mount, and in combination with an interior surface of said housing, at least one of said air passages being adjacent said exterior surface of said heater unit for preheating air flowing through said at least one of said air passages drawn into said housing through said front opening.

24. A hot air gun as claimed in claim 23 wherein said exterior surface of said heater unit consists of heat-conductive material.

25. A hot air gun as claimed in claim 24 wherein said flange consists of heat conductive material and is directly connected to said exterior surface of said heater unit, and said flange extends into at least said a least one of said air inlet passages.

26. A hot air gun as claimed in claim 23 wherein said outlet end of said heater unit projects out of and beyond said front opening of said housing.

* * * * *